US005679070A

United States Patent [19]

Ishida et al.

[11] Patent Number: 5,679,070

[45] Date of Patent: Oct. 21, 1997

[54] COIN PAYOUT DEVICE

[75] Inventors: Takeshi Ishida, Sakado; Jun Yamada, Kawagoe; Genzo Yoshizawa, Tokyo; Kenji Koyama, Kawagoe, all of Japan

[73] Assignee: Kabushiki Kaisha Nippon Conlux, Tokyo, Japan

[21] Appl. No.: 548,983

[22] Filed: Oct. 27, 1995

[30] Foreign Application Priority Data

Oct. 28, 1994 [JP] Japan ..... 6-265448

[51] Int. Cl.[6] ..... G07D 1/00

[52] U.S. Cl. ..... 453/41; 194/200

[58] Field of Search ..... 453/21, 41; 194/200

[56] References Cited

U.S. PATENT DOCUMENTS

| | | | |
|---|---|---|---|
| 4,250,905 | 2/1981 | Kobayashi et al. | 221/13 |
| 4,347,924 | 9/1982 | Hayashi et al. . | |
| 4,374,529 | 2/1983 | Kobayashi et al. | 221/11 X |
| 4,607,650 | 8/1986 | Kobayashi et al. | 221/13 X |

FOREIGN PATENT DOCUMENTS

| | | | |
|---|---|---|---|
| 53-47719 | 12/1978 | Japan . | |
| 57-193881 | 11/1982 | Japan . | |
| 61-256494 | 11/1986 | Japan . | |
| 62-17889 | 1/1987 | Japan . | |
| 4-311293 | 11/1992 | Japan | 453/41 |
| 5-346982 | 12/1993 | Japan . | |
| 94/16411 | 7/1994 | WIPO | 453/41 |

*Primary Examiner*—F. J. Bartuska

*Attorney, Agent, or Firm*—Diller, Ramik & Wight PC

[57] ABSTRACT

A coin payout device that has been improved such that a coin jam will be automatically dislodged in the event that a coin jam occurs, and there will be no problem of overpayment. When coin payout is performed by the forward rotation of a coin payout motor (40), a coin payout controller (80) detects the occurrence of a coin jam from the operational circumstances of a carrier switch (60) up to the time when a first timer (81) runs out, and determines whether the reverse rotation of the coin payout motor (40) would cause a problem based on the current state of the carrier switch (60), so that the coin payout motor (40) is reversed and the coin jam dislodged only when no problem will be caused.

13 Claims, 11 Drawing Sheets

COIN PAYOUT DEVICE

BACKGROUND OF THE INVENTION

1. Field of the Invention

This invention relates to a coin payout device for a vending machine or the like that pays out coins one at a time up to the value of the change from a coin tube by means of the reciprocal motion at the bottom of the coin tube of a coin payout slide positioned at the bottom of the coin tube as a result of the rotation of a coin payout motor, and more particularly to a coin payout device that has been improved such that a coin jam will be automatically dislodged in the event that a coin jam occurs.

2. Description of the Related Art

In general, the coin payout devices in vending machines and the like are designed such that they pay out coins in a coin tube one at a time by means of the reciprocal motion at the bottom of the coin tube of a coin payout slide positioned at the bottom of the coin tube as a result of the rotation of a coin payout motor.

However, the payout of coins can malfunction with a conventional coin payout device as a result of foreign objects being put into the coin payout component during coin payout operation, or as a result of deformed coins, etc. This is referred to as a coin jam, and in such a case the device is designed to halt the coin payout motor after specific period of time and display that there is a malfunction.

When thus the coin payout motor stops and a malfunction is displayed, the vending machine is out of order, and for the machine to be put back in order the coin causing the jam must be manually removed and the malfunction set right.

However, for the coin causing the jam to be taken out, the coin payout component of the coin payout device must be taken apart, and consequently the work involved in solving the problem is very difficult and takes time.

A method known in the past for automatically dislodging a coin jam, as disclosed in Japanese Patent Publication 53-47719, was to temporarily reverse the coin payout motor when a coin jam was detected in a coin payout device having a hopper, and again operate the motor in the forward direction so as to automatically dislodge the coin jam.

However, with a coin payout device for a vending machine or the like that pays out coins one at a time from a coin tube by means of the reciprocal motion at the bottom of the coin tube of a coin payout slide positioned at the bottom of the coin tube as a result of the rotation of a coin payout motor, if the coin payout motor is designed so that it is unconditionally reversed at the time of a coin jam and then operated in the normal direction, a problem referred to as overpayment occurs, whereby coins of the same or different denomination can be paid out in an amount greater than the desired change value depending on the position of the payout slide at the point in time when the coin jam occurs.

When an overpayment is made in the change payout operation of an ordinary vending machine, not only is there a financial loss on the part of the vending machine, but with a vending machine that does not have a pulse switch that is used to keep track of the coins paid out, an error occurs in the count of the coins stored in the coin tube, creating a problem in that accurate change management is impossible.

SUMMARY OF THE INVENTION

In view of this, an object of this invention is to provide a coin payout device that has been improved such that a coin jam can be automatically dislodged in the event of a coin jam, and such that there will be no problem with overpayment.

In order to achieve the stated object, this invention provides a coin payout device that pays out coins one at a time from a coin tube by means of the reciprocal motion at the bottom of the coin tube of a coin payout slide positioned at the bottom of the coin tube as a result of the rotation of a coin payout motor, comprising coin jam detection means for detecting a coin jam if the coin jam occurs during the coin payout operation by the rotation of the coin payout motor, and coin jam automatic dislodging means for automatically dislodging the coin jam, in the event that the coin jam is detected by the coin jam detection means, by reversely rotating the coin payout motor under a condition that the reverse rotation of the coin payout motor will pose no problems.

With this invention, in the event that a coin jam occurs during the coin payout operation by the rotation of the coin payout motor, this coin jam is detected by the coin jam detection means, and in the event that the coin jam has been detected by this coin jam detection means, the coin jam is automatically dislodged by the coin jam automatic dislodging means by reversely rotating the coin payout motor under a condition that the reverse rotation of the coin payout motor will pose no problems.

Here, the coin jam automatic dislodging means is equipped with judgement means for judging whether the reverse rotation of the coin payout motor would cause a problem based on the rotational position of the coin payout motor at the time point when the coin jam has been detected by the coin jam detection means, and with reverse rotation control means for controlling to reversely rotate the coin payout motor only when it has been judged by the judgement means that the reverse rotation of the coin payout motor would not cause a problem.

The coin payout motor is equipped with a carrier cam mounted on the drive shaft of the coin payout motor, and with a carrier switch that is switched on and off depending on the rotational position of the carrier cam. The judgement means judges whether the reverse rotation of the coin payout motor would cause a problem based on the operating state of the carrier switch.

Here, the carrier cam is designed such that the carrier switch is turned off when the payout slide is in its standby position, and such that the carrier switch is turned on when the rotation of the coin payout motor causes the payout slide to reach a position where the coins inside the coin tube will be knocked downward from inside the coin tube.

The judgement means judges whether the carrier switch is on or off at the point when a coin jam has been detected by the coin jam detection means, and the reverse rotation control means controls to reversely rotate the coin payout motor until the carrier switch is off only when it has been judged by the judgement means that the carrier switch is on.

The coin jam detection means is equipped with a first timer that clocks a first period of time, and with a means for detecting as a coin jam a case in which the carrier switch does not turn on and off properly within the first period of time according to the first timer. The judgement means is equipped with a second timer that measures a second period of time from the time point when a coin jam has been detected by the coin jam detection means, and with means for judging whether the carrier switch is on or off after the second period of time has been clocked by the second timer. The reverse rotation control means is equipped with a third timer that clocks a third period of time from the start of the reverse rotation of the coin payout motor, and with means for controlling to reversely rotate the coin payout motor until the clocking of the third period of time by the third timer has been completed or until the carrier switch is turned off.

The reverse rotation control means is further equipped with a fourth timer that begins the clocking of a fourth period of time upon completion of the reverse rotation control, and with a re-reverse rotation control means for controlling to forwardly rotate the coin payout motor upon completion of the clocking of the fourth period of time by the fourth timer, for controlling to re-reversely rotate the coin payout motor in the event that the carrier switch does not properly turn on and off within the first period of time according to the first timer, and for repeating the above controls until the carrier switch does turn on and off properly within the first period of time.

The number of times that the re-reverse rotation control means performs the re-reverse rotation control is limited here to a specific number.

The judgement means comprises counting means that is reset to a specific initial value when the coin payout motor is in a standby mode and that counts the pulses generated in accordance with the rotation of the coin payout motor; and judges whether the reverse rotation of the coin payout motor would cause a problem based on the count of the counting means. Here, the coin payout motor is equipped with a rotating plate that is mounted on the drive shaft of the coin payout motor and in which a plurality of holes have been formed, and with pulse generating means for generating a pulse every time the position of a hole in the rotating plate is detected. The counting means counts the pulses generated from the pulse generating means.

The coin payout motor is equipped with a carrier cam mounted on the drive shaft of the coin payout motor, and with a carrier switch that turns on and off depending on the rotational position of the carrier cam. The coin jam detection means is equipped with a first timer that clocks a first period of time, and with means for detecting as a coin jam a case in which the carrier switch does not turn on and off properly within the first period of time according to the first timer. The judgement means is equipped with a second timer that measures a second period of time from the point when a coin jam has been detected by the coin jam detection means, and with means for judging whether the reverse rotation of the coin payout motor would cause a problem after the second period of time has been clocked by the second timer. The reverse rotation control means is equipped with a third timer that clocks a third period of time from the start of the reverse rotation of the coin payout motor, and with means for controlling to reversely rotating the coin payout motor until the clocking of the third period of time by the third timer has been completed or until the coin payout motor returns to its standby position.

The reverse rotation control means is further equipped with a fourth timer that begins the clocking of a fourth period of time upon completion of the reverse rotation control, and with re-reverse rotation control means for controlling to forwardly rotate the coin payout motor upon completion of the clocking of the fourth period of time by the fourth timer, for controlling to re-reversely rotate the coin payout motor in the event that the carrier switch does not properly turn on and off within the first period of time according to the first timer, and for repeating the above controls until the carrier switch does turn on and off properly within the first period of time.

The number of times that the re-reverse rotation control means performs the re-reverse rotation control is limited here to a specific number.

The coin jam automatic dislodging means is equipped with a coin jam dislodging switch and with a coin payout motor reverse rotation control means for controlling to reversely rotate the coin payout motor under the condition that the coin jam dislodging switch has been operated.

Here, the coin jam dislodging switch is an inventory switch that commands the payout of coins from the coin tube. When a coin jam has been dislodged by the reverse rotation control of the coin payout motor by the coin payout motor reverse rotation control means, the payout of the coins from the coin tube is begun based on a command from the inventory switch.

Thus, with the present invention, in a coin payout device that pays out coins from a coin tube one at a time by means of the reciprocal motion at the bottom of the coin tube of a payout slide positioned at the bottom of the coin tube as a result of the rotation of a coin payout motor, when a coin jam occurs during the payout of coins as a result of the rotation of the coin payout motor, this coin jam is automatically dislodged by the reverse rotation of the coin payout motor under the condition that this reverse rotation of the coin payout motor will not cause any problem.

This judgement that the reverse rotation of the coin payout motor will not cause any problem is made based on the determination of the rotational position of the coin payout motor according to the pulse generator, or based on whether the carrier switch is on or off.

The merit of this is that coin jams can be dislodged automatically as much as possible without any problems such as overpayment being caused.

DESCRIPTION OF THE PREFERRED EMBODIMENTS

Embodiments of the coin payout device relating to the present invention will now be described in detail through reference to the figures.

Figure 1:
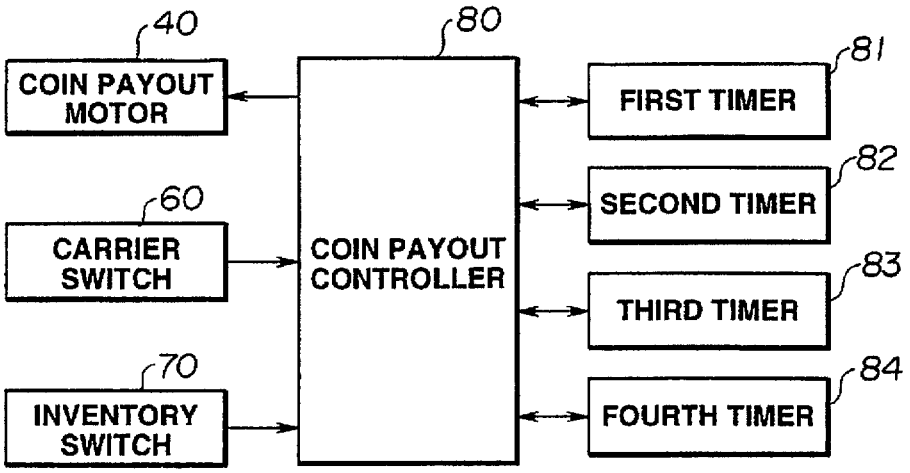
FIG. 1 is a block diagram illustrating the overall structure of the control system of one embodiment of the coin payout device pertaining to the present invention.
Figure 2:
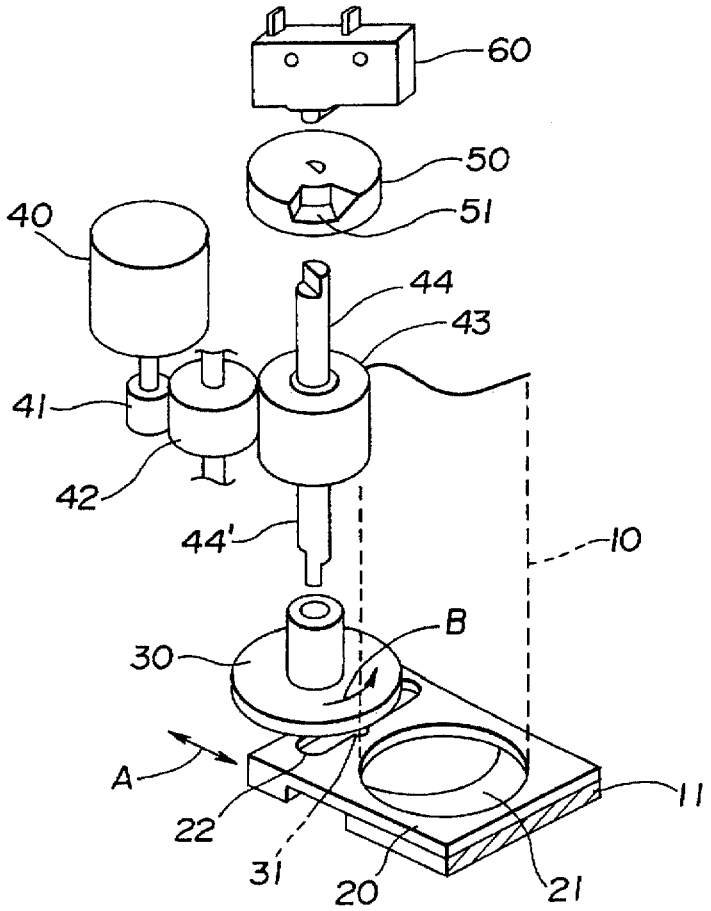
FIG. 2 is a conceptual diagonal view of the simplified structure of the coin payout device in the embodiment shown in FIG. 1.
Figure 3:
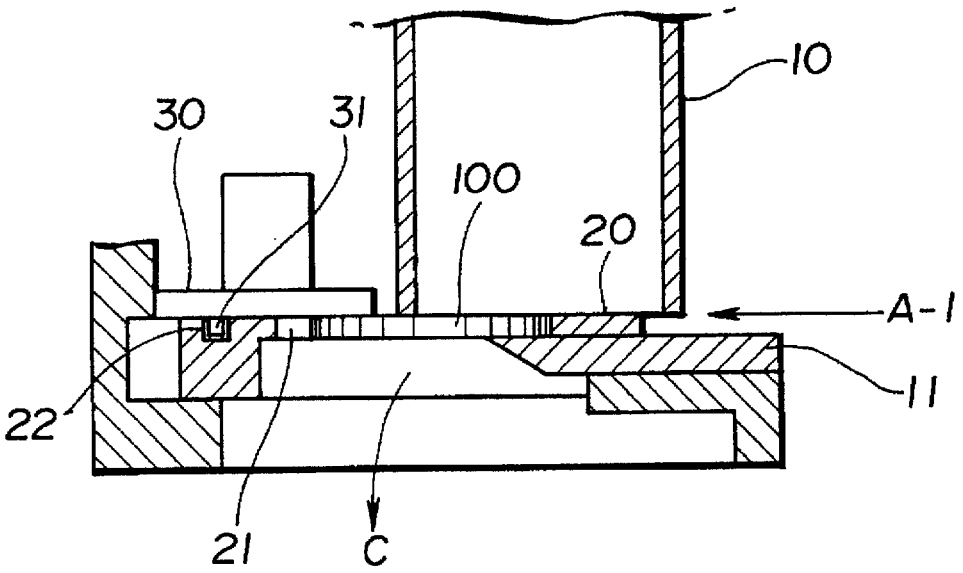
FIG. 3 is a cross section illustrating the operation of the coin payout device in the embodiment shown in FIG. 1.
Figure 4:
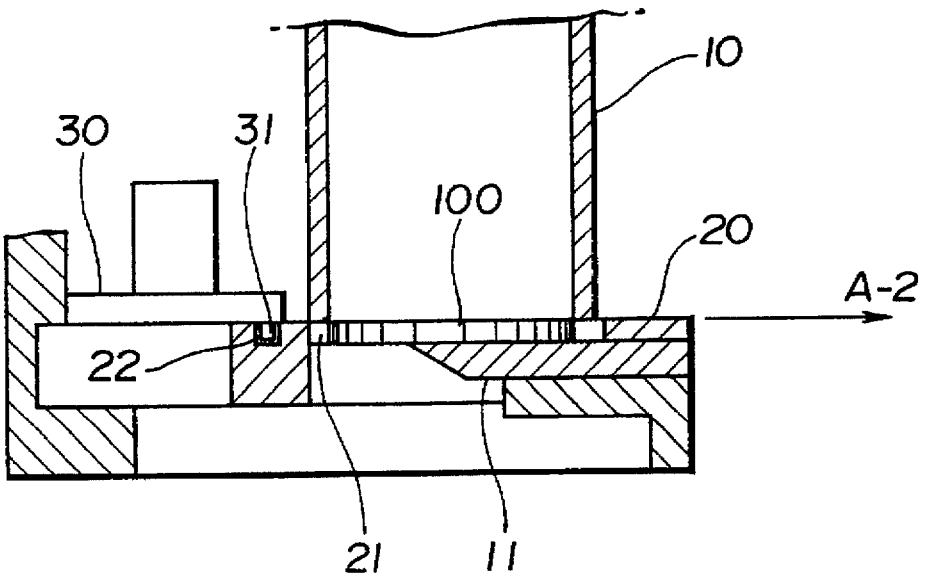
FIG. 4 is a cross section illustrating the operation of the coin payout device in the embodiment shown in FIG. 1.

FIG. 1 is a block diagram illustrating the overall structure of the control system of the coin payout device pertaining to the present invention. FIG. 2 is a conceptual diagonal view of the simplified structure of the coin payout device pertaining to the present invention. FIGS. 3 and 4 are cross sections illustrating the operation of this coin payout device.

In FIG. 2, this coin payout device comprises a coin payout motor 40; gear transmission means 41 through 43 for transmitting the drive force of the coin payout motor 40; a shaft 44 that is rotated by the drive force transmitted through these gear transmission means 41 through 43; a payout cam 30 that is attached to the bottom of the shaft 44 and is rotated by the rotational drive force of a shaft 44'; a payout slide 20 that has a groove 22 which engages with a pin 31 protruding from the lower side of the payout cam 30, and that moves reciprocally in the direction of the arrow A from its initial position in the figure when the payout cam 30 makes one rotation in the direction of the arrow B; a carrier cam 50 that is provided to the top of the shaft 44 and has on its upper side a notch 51 that rotates according to the rotational position of the shaft 44 and the payout cam 30, i.e., the slide position of the payout slide 20 in the A direction; and a carrier switch 60 that is turned on and off depending on the position of the notch 51 in the carrier cam 50.

In the payout slide 20 of this coin payout device is made a hole 21 that holds only the lowermost coin 100 inside a coin tube 10 shown in FIGS. 3 and 4. Part of this hole 21 is covered by a bottom plate 11 so that the coin 100 will not fall out in the initial state in FIG. 2.

The coin payout operation of this coin payout device will be described in reference to FIGS. 1, 2, 3, and 4.

When a signal is output from a coin payout controller 80 in the control system shown in FIG. 1 indicating that the coin held in the hole 21 should be paid out, the coin payout motor 40 goes into action based on this signal, the payout cam 30 is rotated once in the direction of the arrow B by the rotational drive force of the coin payout motor 40, and the payout slide 20 is moved in the direction of the arrow A-1. This results in the coin 100 held in the hole 21 also being moved in the direction of the arrow A-1, and in the coin 100 falling downward (in the C direction) away from the bottom plate 11 and being paid out as shown in FIG. 4. Even after the payout is finished, the coin payout motor 40 continues its rotational drive until the payout cam 30 has made one rotation, so the payout slide 20 now moves in the direction of the arrow A-2 in FIG. 4 and returns to its initial position, so that the next coin falls into the hole 21. A first timer 81, second timer 82, third timer 83, and fourth timer 84 in FIG. 1 are timers which are used in the judgement of the coin payout operation.

When a foreign object finds its way into the hole 21 of the payout slide 20 of the coin payout device, or when a coin is deformed, or when some other such event arises in the middle of this payout operation, a coin jam will occur and the reciprocal motion of the payout slide 20 will come to a halt.

This coin jamming is identified from the on/off operation of the carrier switch 60. In standby mode, the carrier switch 60 is usually off. When a payout is made, the forward rotation of the coin payout motor 40 causes the carrier cam 50 to make one rotation, and the carrier switch 60 is first turned from off to on by the bumps of the notch 51 in the carrier cam 50, after which it returns to a standby mode and goes back to being off. The coin payout controller 80 in FIG. 1 monitors this on/off operation, and determines that the working state is normal when this operation is completed within a certain specified time (T1) that is measured by the first timer 81.

On the other hand, in the event of a coin jam, this coin jam interferes with the forward rotation of the coin payout motor, and the normal on/off operation of the carrier switch 60 is not carried out within the specified time (T1), with the switch being locked in either an on or off state. When the off-on-off operation of the carrier switch 60 is thus not completed within the specified time (T1), the coin payout controller 80 determines a coin jam to have occurred.

In this embodiment, when such a coin jam has occurred it is automatically dislodged by the reverse rotation of the coin payout motor 40 so that it moves the payout slide 20 in the reverse direction.

Figure 5:
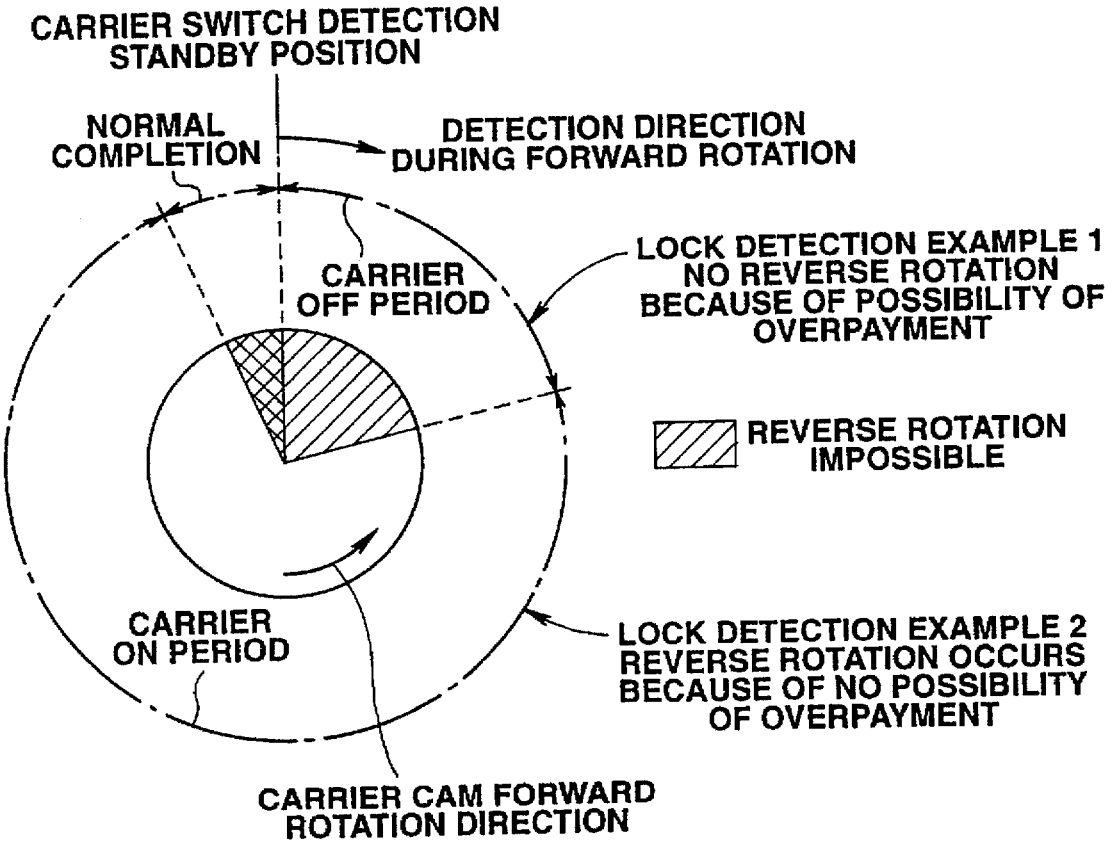
FIG. 5 is a diagram illustrating the relation between the position of the carrier cam, the state of the carrier switch, and whether or not automatic dislodging by means of the reverse rotation of the payout motor will be executed in the coin payout device in the embodiment shown in FIG. 1.

Here, depending on the position where the coin jam (lock detection) occurs, there is a possibility that one extra coin will be paid out by the reverse rotation, resulting in overpayment. The position where such overpayment is likely to occur varies with the structure of the payout mechanism. With an ordinary mechanism, however, a determination can usually be made on the safe side by distinguishing between the on region and the off region of the carrier switch 60. FIG. 5 shows the relation between the on/off state of the carrier switch 60, the position of the carrier cam 50 at the time when the coin jam (lock detection) occurred in this case, and whether automatic dislodging by the reverse rotation of the coin payout motor 40 will be performed.

The solid-line circle in FIG. 5 indicates the position of the carrier cam 50, while the range within the shaded pie-shaped portion is the off position of the carrier switch 60. The position perpendicularly above this circle is the standby position. During the forward rotation of the coin payout motor 40, the circle indicating the position of this carrier cam 50 rotates counterclockwise, and the detection position moves clockwise.

The carrier switch 60 remains off for a while when the coin payout motor 40 is rotated forward, after which it turns on and then finally turns off again. Reverse rotation is only permitted while this carrier switch 60 is on.

Figure 6:
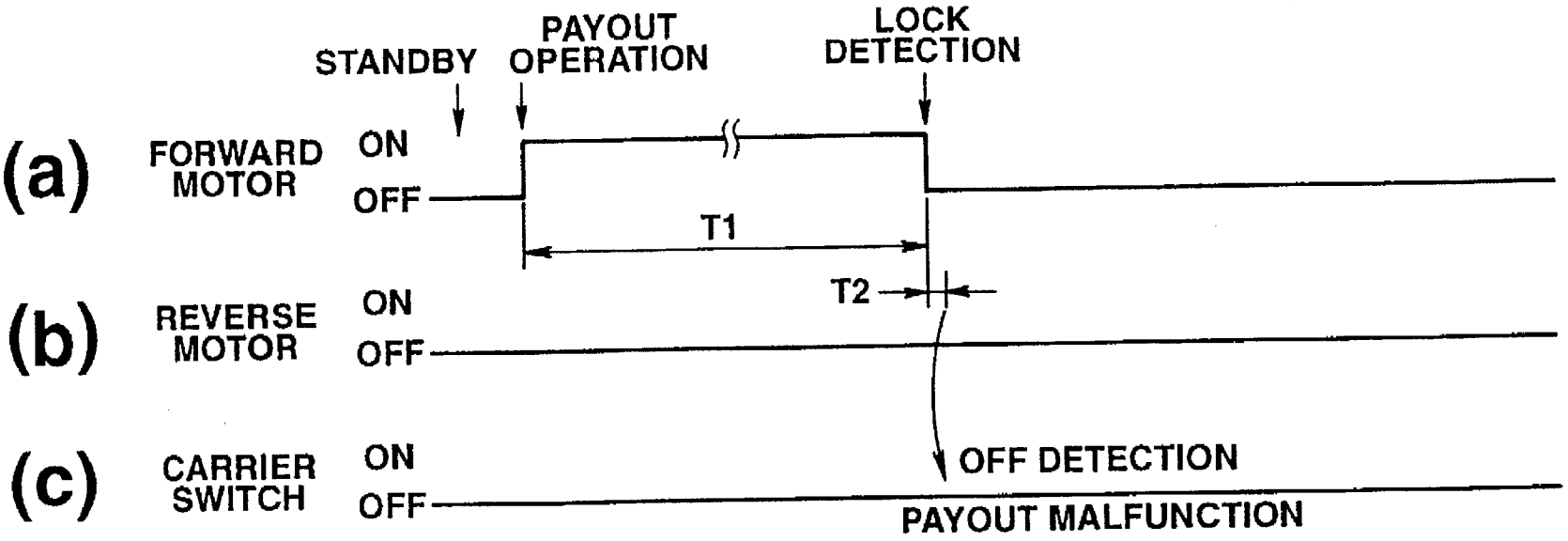
FIG. 6 is a timing chart that illustrates the operation of the carrier switch and the coin payout motor in the coin payout device in the embodiment shown in FIG. 1.

FIG. 6 is a timing chart that illustrates the operation of the carrier switch 60 and the coin payout motor 40 when a coin jam (lock detection) has occurred, the carrier switch 60 is off, and reverse rotation has not been performed. Part (a) of FIG. 6 shows the forward rotation of the coin payout motor 40, part (b) shows the reverse rotation of the coin payout motor 40, and part (c) shows the on/off state of the carrier switch 60.

The device goes from standby mode into payout operation, and the coin payout controller 80 in FIG. 1 initiates the forward rotation of the coin payout motor 40 (part (a) of FIG. 6) and monitors the state of the carrier switch 60 (part (c) of FIG. 6). However, since the carrier switch 60 does not turn on even after the elapse of the specified time T1 has been determined by the first timer 81, it is determined that a coin jam (lock detection) has occurred, and the forward rotation of the coin payout motor 40 is halted. After this, the device waits T2 time as measured by the second timer 82, and further judges whether the carrier switch 60 is on or off. If the carrier switch 60 is still off, no reverse rotation (part (b) of FIG. 6) is allowed because of the possibility of overpayment, and a payout malfunction display is performed by a suitable method as in the past, the system is halted, and the device waits for the jam to be dislodged by a manual method. The reason for the extra T2 time after the coin payout motor 40 has been halted is that there is a possibility that the state of the carrier switch 60 will change by inertia, so this time is taken as a waiting timer until the state of the carrier switch 60 has stabilized. If the carrier switch 60 turns on after T2 time, then the forward rotation of the coin payout motor 40 is again started and the subsequent situation is judged.

Figure 7:
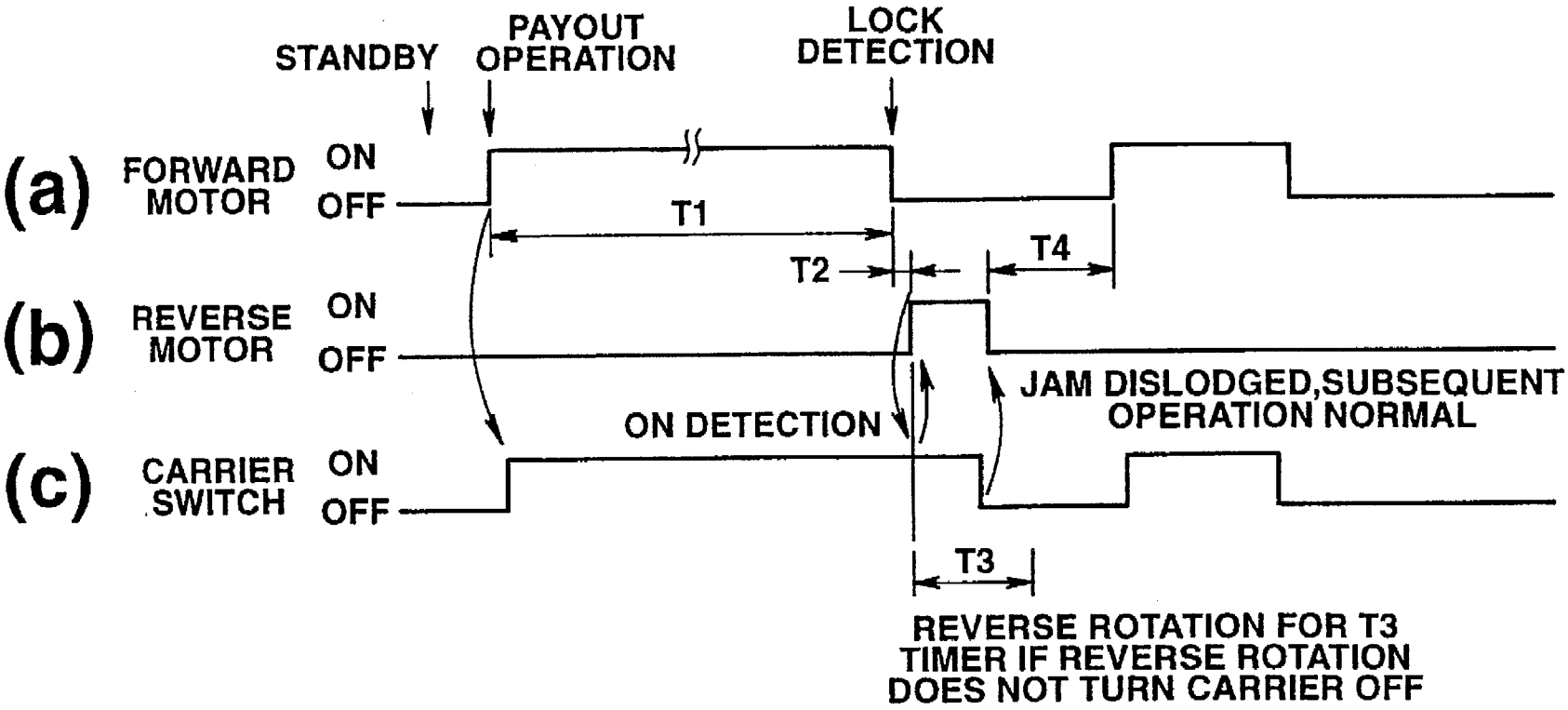
FIG. 7 is a timing chart that illustrates the operation of the carrier switch and the coin payout motor in the coin payout device in the embodiment shown in FIG. 1.

FIG. 7 is a timing chart that illustrates the operation when a coin jam (lock detection) has occurred and the carrier switch 60 is on.

The device goes from standby mode into payout operation, and the coin payout controller 80 in FIG. 1 initiates the forward rotation of the coin payout motor 40 (part (a) of FIG. 7) and monitors the state of the carrier switch 60. As shown in part (c) of FIG. 7, the carrier switch 60 temporarily goes from being off to being on at this time, and remains on instead of returning to being off even after the first timer 81 has determined that the specified T1 time has elapsed. As a result, the coin payout controller 80 determines that a coin jam (lock detection) has occurred and halts the forward rotation of the coin payout motor 40.

After this, the device waits T2 time as measured by the second timer 82, and further judges whether the carrier switch 60 is on or off. If the carrier switch 60 is still on, then there is no possibility of overpayment, so the coin payout motor 40 is reversed for the sake of automatic jam dislodging. During this reverse rotation, the coin payout controller 80 monitors the third timer 83 and the state of the carrier switch 60 and halts the reverse rotation of the coin payout motor 40 if the carrier switch 60 goes off or if T3 time elapses from the start of the reverse rotation.

After the reverse rotation has ended as a result of the carrier switch 60 being off or of the elapse of T3 time, a waiting time of at least T4 time according to the fourth timer 84 is allowed to pass before normal payout operation is resumed. If the carrier switch 60 turns on and off properly in this operation, then the payout is considered to be functioning properly, and the number of coins in the payout in question is reduced or increased as specified.

In the event that the carrier switch 60 still does not turn on and off properly in the normal payout operation performed after this reverse rotation, then either a payout malfunction is determined to be in effect at this point, or a re-reverse rotation is performed to try to dislodge the jam one more time. This re-reverse rotation performed here is limited to a few times, and is performed few enough times to avoid burning out the coin payout motor 40.

As discussed above, when there is the possibility of overpayment, a payout malfunction notification is made, and the device waits for manual jam dislodgement. The manual rectification of the payout malfunction is accomplished by operation of the inventory switch 70 shown in FIG. 1.

Since the inventory switch 70 is only operated under the supervision of a routeman or another such worker, first the reverse rotation of the coin payout motor 40 is performed regardless of whether the carrier switch 60 is on or off, and then the coin payout motor 40 is rotated forwardly once the payout malfunction has been properly rectified, normal operation begins from that point.

Since the inventory switch 70 is thus only used by a routeman or another such worker, even if an overpayment is made in the course of dislodging the jam, there will be no financial loss to the vending machine, and since the error in the number of remaining coins in the automatic change inventory function can be reset and corrected, the reverse rotation control can be repeated as needed regardless of whether the carrier switch 60 is on or off.

Figure 8:
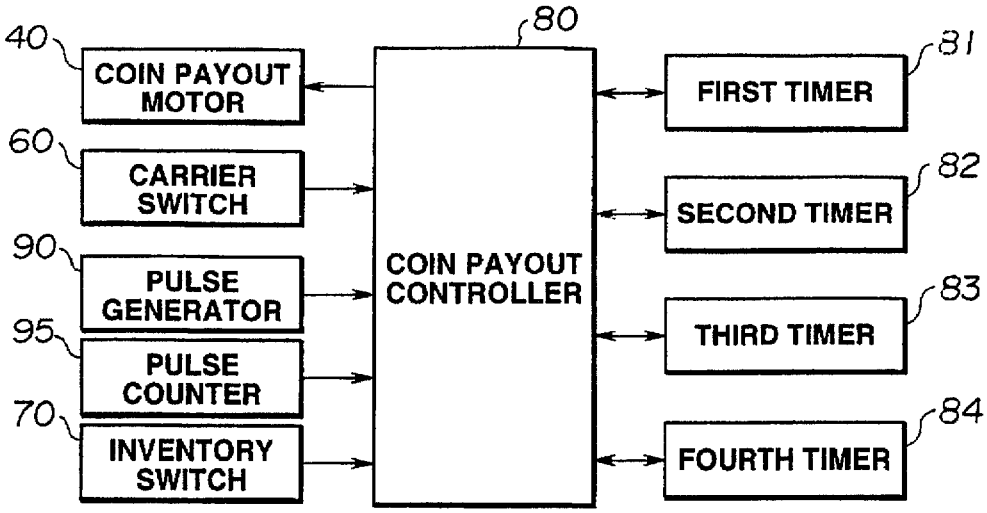
FIG. 8 is a block diagram illustrating the overall structure of the control system of another embodiment of the coin payout device pertaining to the present invention.

As previously mentioned, the determination of the possibility of an overpayment can most often be made on the safe side through distinguishing between the on region and the off region of the carrier switch 60 with an ordinary mechanism, but if there is the possibility of an overpayment even when the carrier switch 60 is on, then this requires the adoption of a method for specifying the prohibition of reverse rotation by the provision of a separate means for determining the rotational position of the coin payout motor 40. FIG. 8 is a block diagram of a control system of the coin payout device in this case. With this circuit, a pulse generator 90 that generates pulses according to the rotation of the coin payout motor 40, and a pulse counter 95 that is reset in the standby mode and thereafter counts by addition and subtraction the pulses generated according to the rotation of the coin payout motor 40, are provided as the means for determining the rotational position.

Figure 9:
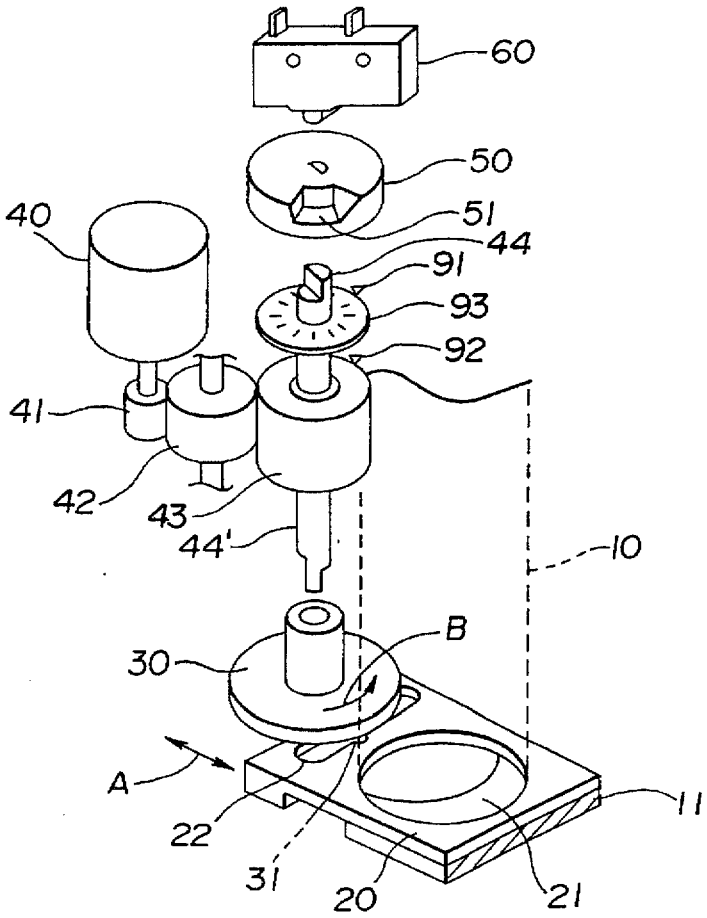
FIG. 9 is a conceptual diagonal view of the simplified structure of the coin payout device in the embodiment shown in FIG. 8.

FIG. 9 shows an example in which a photointerrupter device having a light-emitting element 91 and a light-receiving element 92 is used for this pulse generator 90. A rotating plate 93 has a plurality of holes made in an opaque plate, or an opaque scale engraved in a transparent plate, and is designed such that the light-receiving element 92 receives pulse-form signals as the coin payout motor 40 rotates.

When this device is used, the number of pulse signals obtained by a single normal payout operation, and the number of pulse signals up to the position where an overpayment occurs in reverse rotation in the event of a jam, are counted up ahead of time and the ranges thereof are set. With a method such as this, the region in which automatic dislodging is not permitted can be set narrowly, and the region in which automatic dislodging is possible can be expanded.

Even when there are a plurality of regions in which overpayment will occur, this can be dealt with by the provision of a plurality of reverse rotation prohibition ranges, and the efficient and reliable designation of regions is possible if the increments of the pulse scale are made narrower.

Figure 10:
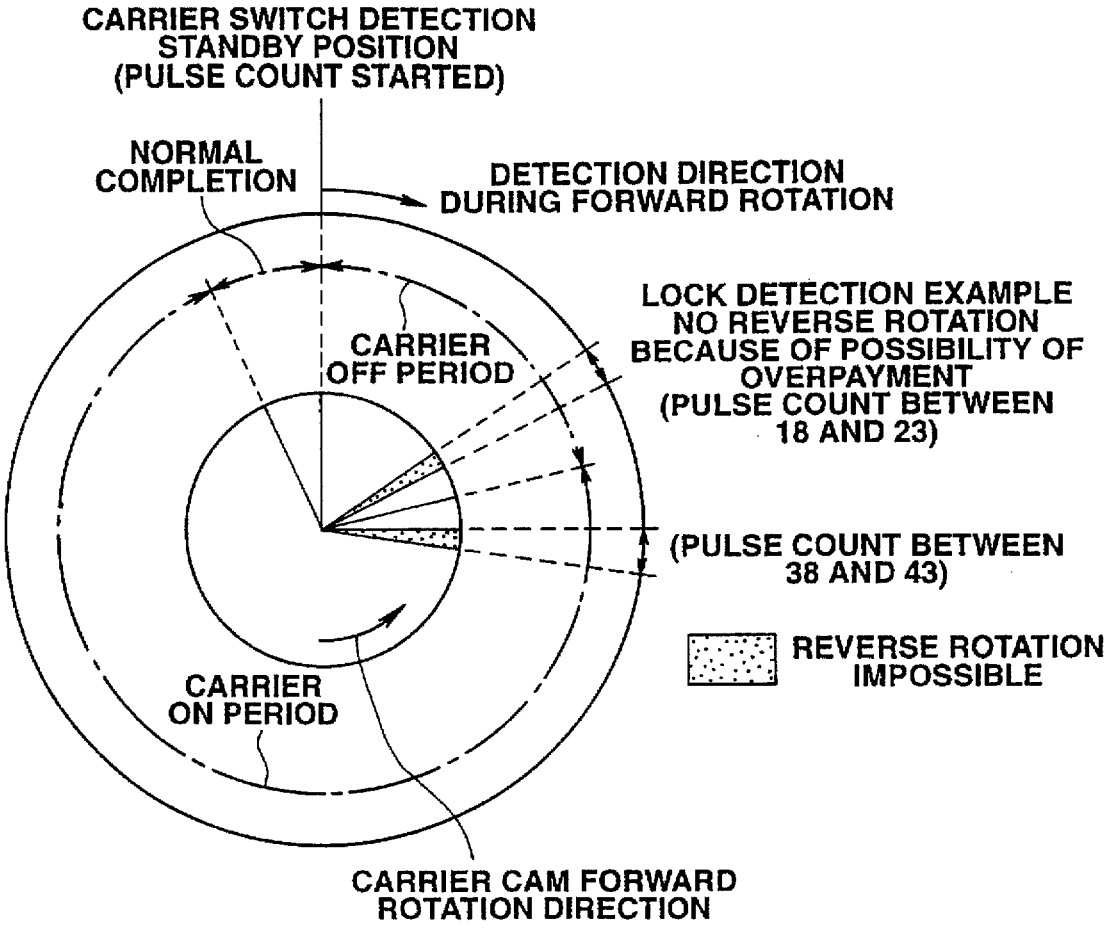
FIG. 10 is a diagram illustrating the relation between the position of the carrier cam, the state of the carrier switch, the pulse count output by the pulse generator, and whether or not automatic dislodging by means of the reverse rotation of the payout motor will be executed in the coin payout device in the embodiment shown in FIG. 8.

FIG. 10 shows the relation between the position of the carrier cam 50 at the point when a coin jam (lock detection) has occurred in this case, whether the carrier switch 60 is on or off, and the range over which automatic dislodging by the reverse rotation of the coin payout motor 40 is prohibited. In this example, the ranges in which reverse rotation is not permitted are the range in which the pulse count from the standby position where the carrier switch 60 is off is 18 to 23, and the range in which the pulse count from the standby position where the carrier switch 60 is on is 38 to 43.

Figure 11:
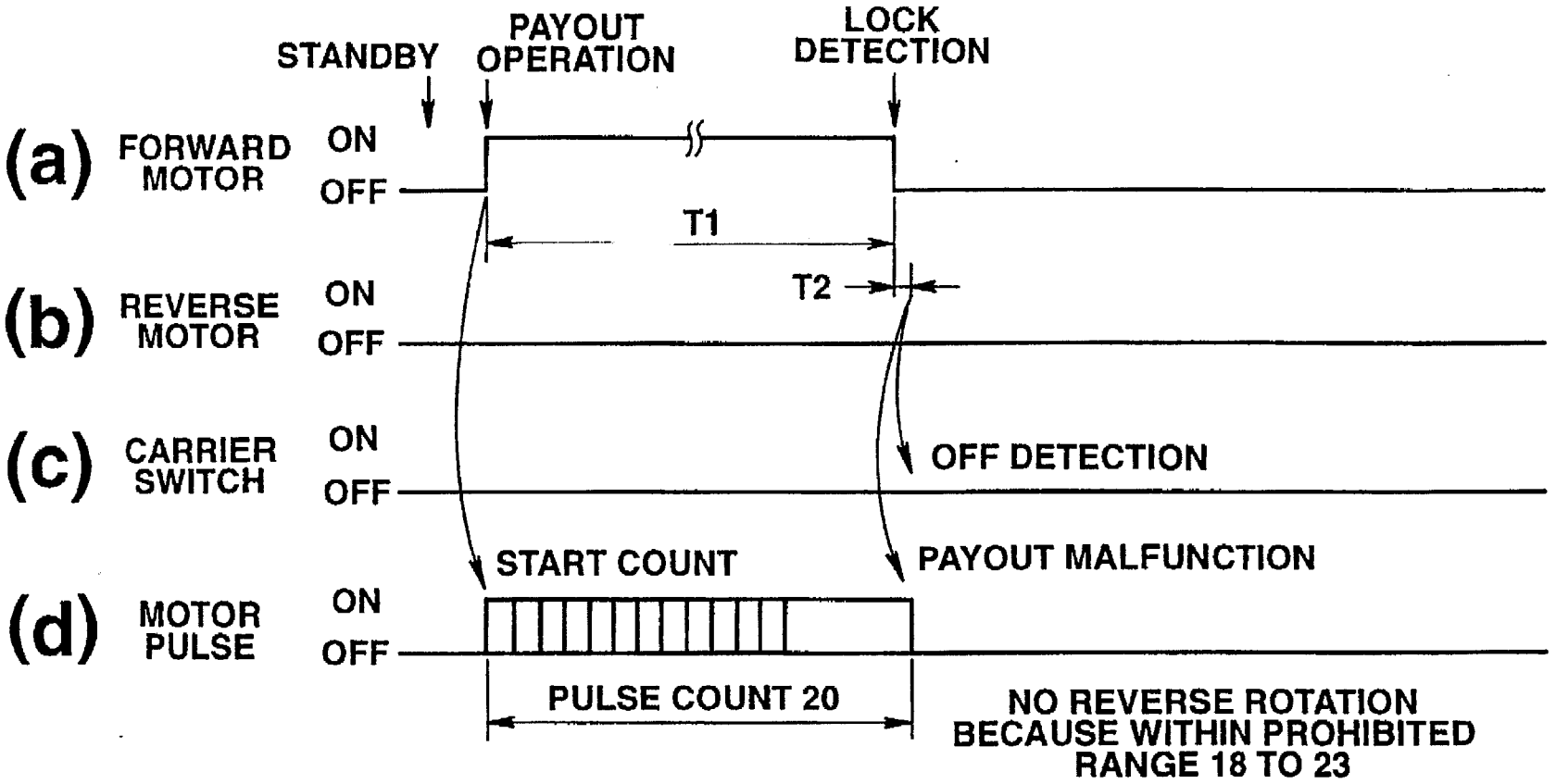
FIG. 11 is a timing chart that illustrates the operation of the coin payout motor, the carrier switch, and the pulse generator in the coin payout device in the embodiment shown in FIG. 8.

FIG. 11 is a timing chart that illustrates the operation when a coin jam (lock detection) has occurred, the pulse count is in a prohibited range, and no reverse rotation has been performed. Part (a) of FIG. 11 (a) shows the forward rotation of the coin payout motor 40, part (b) shows the reverse rotation of the coin payout motor 40, part (c) shows the on/off state of the carrier switch 60, and part (d) shows the pulse count state. In this example, the carrier switch 60 (c) does not turn on even after the elapse of T1 time from the start of the coin payout motor forward operation (a) resulting from payout operation, so the occurrence of a coin jam (lock detection) is detected, the coin payout motor 40 is halted, and the pulse count (d) is checked after waiting for T2 time. Since the pulse count (d) at this point is 20, which is within a prohibited range, the reverse rotation (b) of the coin payout motor 40 is not performed, a separate notification of malfunction is made, and the device waits for manual dislodgement.

Figure 12:
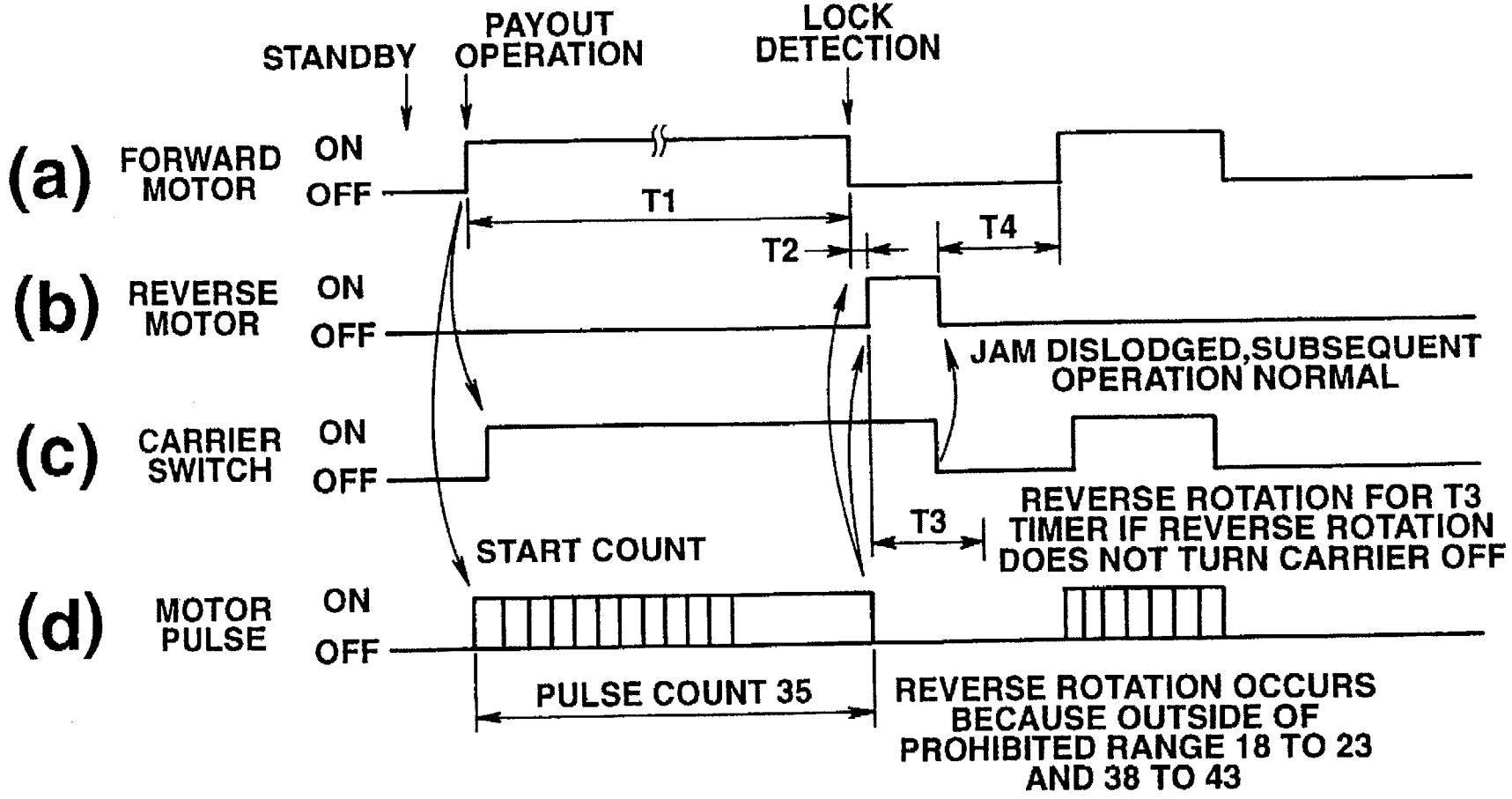
FIG. 12 is a timing chart that illustrates the operation of the coin payout motor, the carrier switch, and the pulse generator in the coin payout device in the embodiment shown in FIG. 8.
Figure 13:
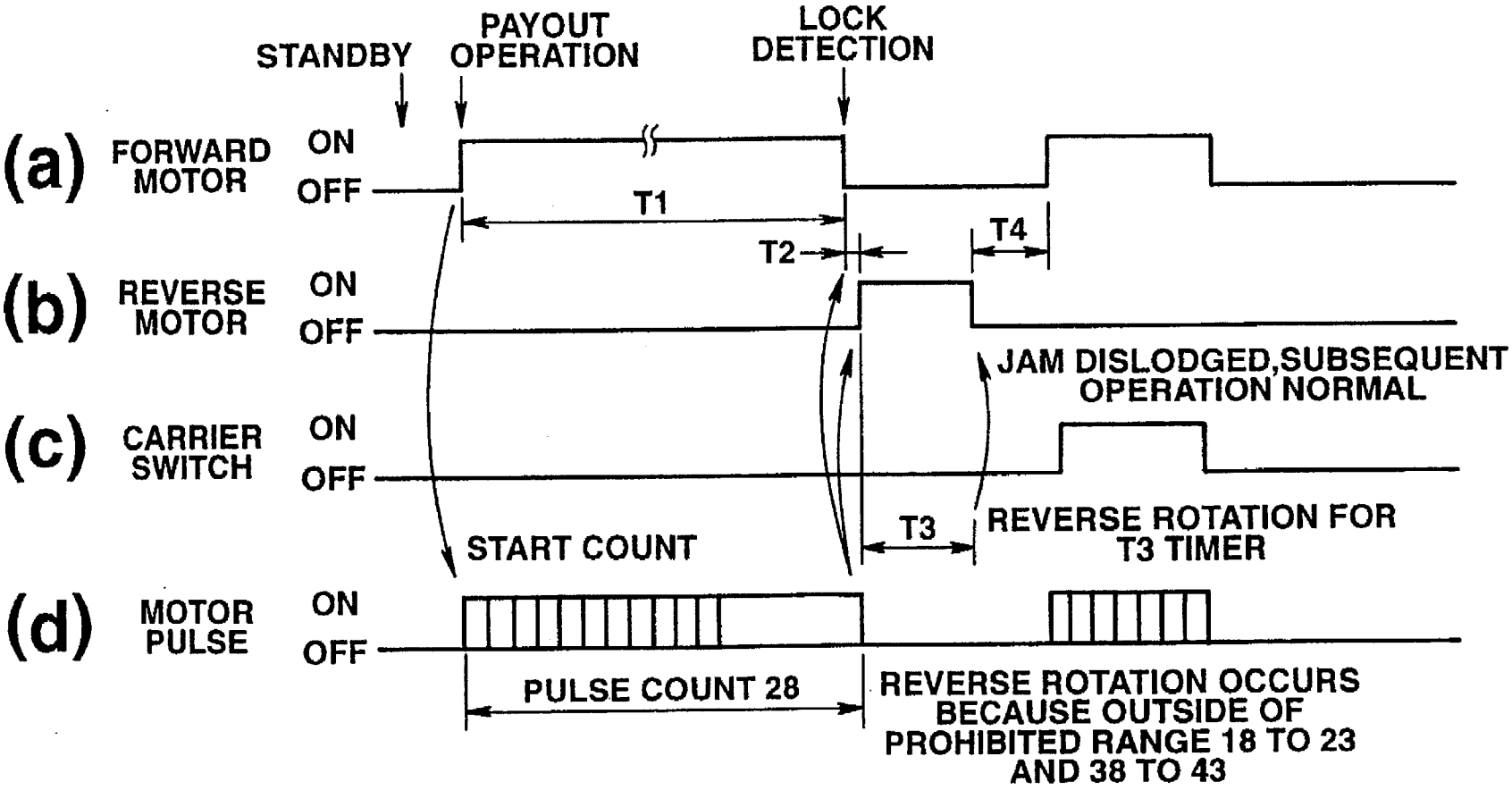
FIG. 13 is a timing chart that illustrates the operation of the coin payout motor, the carrier switch, and the pulse generator in the coin payout device in the embodiment shown in FIG. 8.

FIGS. 12 and 13 are timing charts that illustrate a case in which a coin jam (lock detection) has occurred, the pulse count is outside the prohibited range, and reverse rotation is performed.

In the example in FIG. 12, the carrier switch 60 (c) remains on and does not turn off even after the elapse of T1 time from the start of the coin payout motor forward rotation (a) resulting from payout operation, so the occurrence of a coin jam (lock detection) is detected, the coin payout motor 40 is halted, and the pulse count (d) is checked after waiting for T2 time more. Since the pulse count (d) at this point is 35, which is outside the prohibited range, the reverse rotation (b) of the coin payout motor 40 is performed. As a result, the carrier switch 60 (c) turns off, so the reverse rotation (b) of the coin payout motor 40 is halted and normal payout operation is performed after T4 time. Since this payout operation was carried out normally, it is determined that the coin jam has been dislodged.

In the example in FIG. 13, the carrier switch 60 (c) remains off and does not turn on even after the elapse of T1 time from the start of the coin payout motor forward rotation (a) resulting from payout operation, so the occurrence of a coin jam (lock detection) is detected, the coin payout motor 40 is halted, and the pulse count (d) is checked after waiting for T2 time. Since the pulse count (d) at this point is 28, which is outside the prohibited range, the reverse rotation (b) of the coin payout motor 40 is performed. Even so, since T3 time has elapsed while the carrier switch 60 (c) was off, the reverse rotation (b) of the coin payout motor 40 is halted and normal payout operation is performed after T4 time. Since this payout operation was carried out normally, it is determined that the coin jam has been dislodged.

Figure 14:
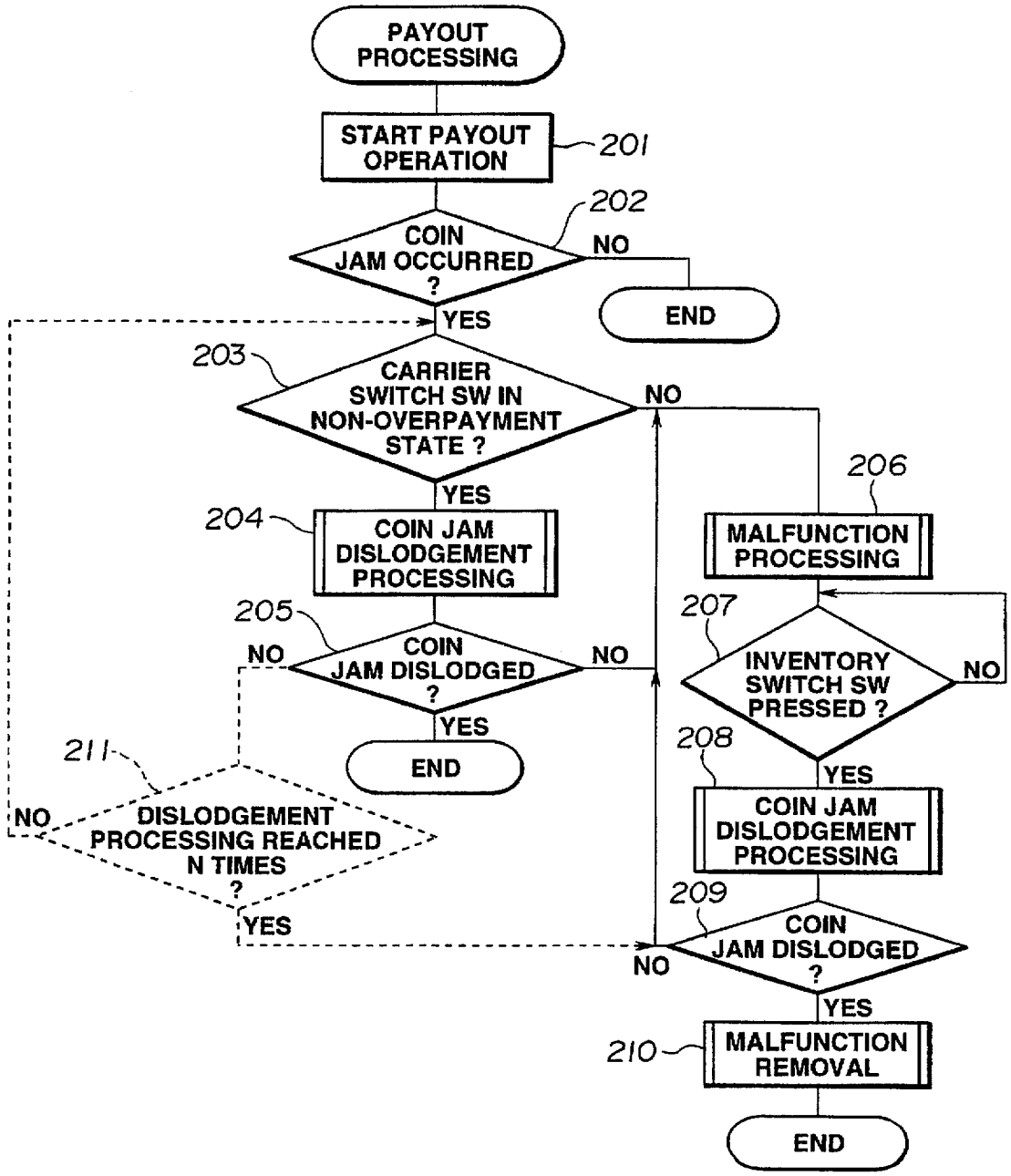
FIG. 14 is a flow chart that illustrates the details involved in dealing with a coin jam that occurs during payout in the embodiment of the present invention.

FIG. 14 is a flow chart of the processing of the coin payout controller 80 structured as discussed above.

In FIG. 14, the coin payout processing starts with the coin payout operation being initiated by the forward rotation control of the coin payout motor 40 (step 201).

Next, a check is made for the occurrence of a coin jam (lock detection) (step 202). This determination of whether a coin jam (lock detection) has occurred is made as follows. The coin payout controller 80 monitors the output of the carrier switch 60, and if the carrier switch 60 does not properly turn on and off within the time T1 clocked by the first timer 81 despite the forward rotation control of the coin payout motor 40, it is determined that there is a coin jam (lock detection) at the end of the time T1 clocked by the first timer 81.

When the determination in this step 202 is that no coin jam has occurred, then this coin payout processing is concluded without further steps.

When the determination in this step 202 is that coin jam has occurred, then the output of the carrier switch 60 at the time point when this coin jam occurred is checked, and a determination is made as to whether the carrier switch 60 is in a non-overpayment state (step 203).

If it is a state in which no overpayment will be made, then a series of operations, such as the reverse rotation of the coin payout motor 40 as discussed above, is carried out as coin jam dislodging processing in step 204. A determination is made as to whether this has dislodged the coin jam (step 205), and if it is determined that the jam has been dislodged, the processing is complete. If the coin jam has not been dislodged, the dislodgement processing returns to step 203 as long as the number of repetitions is within N times (step 211), a determination is made as to whether in the non-overpayment state, and the coin jam dislodgement processing (step 204) is repeated.

When the dislodgement processing reaches N times, the processing for step 206 and beyond (discussed below) is performed, just as when it has been determined in step 203 that there is a possibility of overpayment.

When it has been determined in step 203 that there is a possibility of overpayment, if dislodgement was impossible even after N times of dislodgement processing, then in order to perform the dislodgement processing manually, the malfunction processing shown in step 206 is performed, a coin jam malfunction display is made by some means, and the device waits for the inventory switch 70 to be pressed in step 207.

When the inventory switch 70 is pressed, the same coin jam dislodgement processing (step 208) as in step 204 is carried out unconditionally, a determination is made as to whether the coin jam has been dislodged in step 209, and if it has, the malfunction processing performed in step 206 (such as malfunction display and system shutdown) is stopped, and the process is completed after the correction of the inventory error of the automatic change inventory device, etc. If the coin jam has not been dislodged, then the system continues the malfunction display and waits for the inventory switch 70 to be pressed again.

What is claimed is:

1. A coin payout device that pays out coins in a coin tube one at a time by means of a reciprocal motion at a bottom of the coin tube of a coin payout slide positioned at the bottom of the coin tube as a result of a rotation of a coin payout motor comprising:

coin jam detection means for detecting a coin jam that occurs during a coin payout operation by the rotation of the coin payout motor;

coin jam automatic dislodging means for automatically dislodging the coin jam in the event that the coin jam is detected by the coin jam detection means, by reversely rotating the coin payout motor under a condition that the reverse rotation of the coin payout motor will pose no problems, said coin jam dislodging means comprises:

judgement means for judging whether the reverse rotation of the coin payout motor would cause a problem based on a rotational position of the coin payout motor at a time point when the coin jam has been detected by the coin jam detection means; and reverse rotation control means for controlling to reversely rotate the coin payout motor only when it has been judged by the judgement means that the reverse rotation of the coin payout motor would not cause a problem.

2. A coin payout device as defined in claim 1, wherein the coin payout motor comprises:

a carrier cam mounted on a drive shaft of the coin payout motor; and a carrier switch that is switched on and off depending on a rotational position of the carrier cam; and the judgement means judges whether the reverse rotation of the coin payout motor would cause a problem based on an operating state of the carrier switch.

3. A coin payout device as defined in claim 2, wherein the carrier cam is designed such that the carrier switch is turned off when the payout slide is in its standby position, and such that the carrier switch is turned on when the rotation of the coin payout motor causes the payout slide to reach a position where the coins inside the coin tube will be knocked downward from inside the coin tube.

4. A coin payout device as defined in claim 3, wherein the judgement means judges whether the carrier switch is on or off at a time point when the coin jam has been detected by the coin jam detection means; and the reverse rotation control means controls to reversely rotate the coin payout motor until the carrier switch is off only when it has been judged by the judgement means that the carrier switch is on.

5. A coin payout device as defined in claim 3, wherein the coin jam detection means comprises:

a first timer that clocks a first period of time; and means for detecting as a coin jam a case in which the carrier switch does not turn on and off properly within the first period of time according to the first timer;

the judgement means comprises:

a second timer that measures a second period of time from the time point when the coin jam has been detected by the coin jam detection means; and means for judging whether the carrier switch is on or off after the second period of time has been clocked by the second timer; and the reverse rotation control means comprises:

a third timer that clocks a third period of time from the start of the reverse rotation of the coin payout motor; and means for controlling to reversely rotate the coin payout motor until the clocking of the third period of time by the third timer has been completed or until the carrier switch is turned off.

6. A coin payout device as defined in claim 5, wherein the reverse rotation control means further comprises:

a fourth timer that begins the clocking of a fourth period of time upon completion of the reverse rotation control; and re-reverse rotation control means for controlling to forwardly rotate the coin payout motor upon completion of the clocking of the fourth period of time by the fourth timer, for controlling to re-reversely rotate the coin payout motor in the event that the carrier switch does not properly turn on and off within the first period of time according to the first timer, and for repeating the above controls until the carrier switch does turn on and off properly within the first period of time.

7. A coin payout device as defined in claim 6, wherein the number of times that the re-reverse rotation control means performs the re-reverse rotation control is limited to a specific number.

8. A coin payout device as defined in claim 1, wherein the judgement means comprises:

counting means that is reset to a specific initial value when the coin payout motor is in a standby mode and that counts pulses generated in accordance with the rotation of the coin payout motor; and judges whether the reverse rotation of the coin payout motor would cause a problem based on the count of the counting means.

9. A coin payout device as defined in claim 8, wherein the coin payout motor comprises:

a rotating plate that is mounted on the drive shaft of the coin payout motor and in which a plurality of holes have been formed; and pulse generating means for generating a pulse every time the position of a hole in the rotating plate is detected; and the counting means counts the pulses generated from the pulse generating means.

10. A coin payout device as defined in claim 8, wherein the coin payout motor comprises:

a carrier cam mounted on a drive shaft of the coin payout motor; and a carrier switch that turns on and off depending on a rotational position of the carrier cam;

the coin jam detection means comprises:

a first timer that clocks a first period of time; and means for detecting as a coin jam a case in which the carrier switch does not turn on and off properly within the first period of time according to the first timer;

the judgement means comprises:

a second timer that measures a second period of time from the time point when the coin jam has been detected by the coin jam detection means; and means for judging whether the reverse rotation of the coin payout motor would cause a problem after the second period of time has been clocked by the second timer; and the reverse rotation control means comprises:

a third timer that clocks a third period of time from the start of the reverse rotation of the coin payout motor; and means for controlling to reversely rotate the coin payout motor until the clocking of the third period of time by the third timer has been completed or until the coin payout motor returns to its standby position.

11. A coin payout device as defined in claim 10, wherein the reverse rotation control means further comprises:

a fourth timer that begins the clocking of a fourth period of time upon completion of the reverse rotation control; and re-reverse rotation control means for controlling to forwardly rotate the coin payout motor upon completion of the clocking of the fourth period of time by the fourth timer, for controlling to re-reversely rotate the coin payout motor in the event that the carrier switch does not properly turn on and off within the first period of time according to the first timer, and for repeating the above controls until the carrier switch does turn on and off properly within the first period of time.

12. A coin payout device as defined in claim 11, wherein the number of times that the re-reverse rotation control means performs re-reverse rotation control is limited to a specific number.

13. A coin payout device that pays out coins in a coin tube one at a time by means of a reciprocal motion at a bottom of the coin tube of a coin payout slide positioned at the bottom of the coin tube as a result of a rotation of a coin payout motor comprising:

coin jam detection means for detecting a coin jam that occurs during a coin payout operation by the rotation of the coin payout motor;

coin jam automatic dislodging means for automatically dislodging the coin jam in the event that the coin jam is detected by the coin jam detection means, by reversely rotating the coin payout motor under a condition that the reverse rotation of the coin payout motor will pose no problems, wherein the coin jam automatic dislodging means comprises:

a coin jam dislodging switch;

coin payout motor reverse rotation control means for controlling to reversely rotate the coin payout motor under a condition that the coin jam dislodging switch has been operated, and the coin jam dislodging switch is an inventory switch that commands the payout of coins from the coin tube, and when the coin jam has been dislodged by the reverse rotation control of the coin payout motor by the coin payout motor reverse rotation control means, the payout of the coins from the coin tube is begun based on a command from the inventory switch.

* * * * *